US011724511B2

(12) United States Patent
Nakamura et al.

(10) Patent No.: US 11,724,511 B2
(45) Date of Patent: Aug. 15, 2023

(54) LIQUID EJECTION APPARATUS

(71) Applicant: CANON KABUSHIKI KAISHA, Tokyo (JP)

(72) Inventors: Yohei Nakamura, Kanagawa (JP); Kazuhiro Yamada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/549,664

(22) Filed: Dec. 13, 2021

(65) Prior Publication Data

US 2022/0194089 A1 Jun. 23, 2022

(30) Foreign Application Priority Data

Dec. 21, 2020 (JP) ..... 2020-211644

(51) Int. Cl.
*B41J 2/175* (2006.01)
*B41J 2/18* (2006.01)

(52) U.S. Cl.
CPC ..... *B41J 2/17596* (2013.01); *B41J 2/18* (2013.01)

(58) Field of Classification Search
CPC .... B41J 2/175; B41J 2/17513; B41J 2/17596; B41J 2/18; B41J 29/38
See application file for complete search history.

(56) References Cited

U.S. PATENT DOCUMENTS

2010/0245465 A1 9/2010 Nakamura et al.
2018/0093490 A1 4/2018 Kamei et al.
2020/0230972 A1* 7/2020 Nakajima ..... B41J 2/1707
2020/0276817 A1* 9/2020 Owaki ..... B41J 2/1433

FOREIGN PATENT DOCUMENTS

| | | | |
|---|---|---|---|
| CN | 102218927 | A | 10/2011 |
| CN | 105034604 | A | 11/2015 |
| CN | 106994826 | A | 8/2017 |
| CN | 110497699 | A | 11/2019 |
| EP | 3725527 | A1 | 10/2020 |
| JP | 2010228238 | A | 10/2010 |
| JP | 2017213770 | A | 12/2017 |
| JP | 6256692 | B2 | 1/2018 |
| JP | 2019142107 | A | 8/2019 |

* cited by examiner

*Primary Examiner* — Anh T Vo
(74) *Attorney, Agent, or Firm* — Canon U.S.A., Inc. IP Division

(57) ABSTRACT

A liquid ejection apparatus comprising: two flow passages for supplying or recovering a liquid to an element substrate for ejecting the liquid; a circulation supply flow passage for supplying liquid to oneflow passage, a circulation recovery flow passage for recovering liquid from the other flow passage, and a plurality of on-off valve mechanisms for controlling communication and shutoff between the respective flow passages; the on-off valve mechanism comprises an opening located between flow passages, a sealing portion capable of on-off the opening, an urging member for urging the sealing portion in a direction to approach or away from the opening, and a movement mechanism for moving the sealing portion against the urging force of the urging member, the liquid discharge device controls opening and closing of at least two on-off valve mechanisms by moving the scaling parts of at least two on-off valve mechanisms together by the movement mechanism.

19 Claims, 9 Drawing Sheets

LIQUID EJECTION APPARATUS

BACKGROUND

Field of the Disclosure

The present disclosure relates to a liquid ejection apparatus.

Description of the Related Art

A liquid ejection head of a liquid ejection apparatus comprises a control valve for controlling the supply of a liquid for an initial filling operation for filling an internal flow passage with a liquid and a recovery operation for discharging a thickened liquid or bubbles in the flow passage from an ejection port. Japanese Patent Application Laid-Open No. 2019-142107 discloses a structure in which a flexible member expanded by pressurization of a gas in a gas chamber presses a control valve to forcibly open the control valve.

In addition, there is a circulation type liquid ejection apparatus for flowing the liquid in the liquid ejection head for the purpose of discharging bubbles in the flow passage and preventing the liquid near the ejection port from increasing in viscosity. In the circulation type liquid ejection apparatus, bubbles which may cause ejection failure of the liquid ejection head can be recovered in the liquid container together with the liquid by circulating the liquid between the liquid ejection head and the liquid container. Japanese Patent No. 6256692 discloses a configuration in which ink can be supplied to and recovered from a liquid ejection head without passing through a pressure adjusting unit by switching a flow passage.

In order to realize a configuration in which the circulation flow passage can be switched as described in Japanese Patent Application Laid-Open No. 2019-142107 by using 4 control valves (on-off valve mechanisms) as described in Japanese Patent No. 6256692, four gas chambers are required and the volume of the liquid ejection head increases, in particular, in a liquid ejection head for ejecting a plurality of liquids of different colors, it is necessary to mount a large number of switching mechanisms on the carriage in accordance with the number of liquids (the number of colors of the liquids). However, in a liquid ejection apparatus for scanning a carriage mounted with a liquid ejection head, it is preferable that a member mounted on the carriage is small and lightweight. For example, since the size of the on-off valve mechanism constituting the switching mechanism may affect the movement of the carriage, the on-off valve mechanism is preferably small.

SUMMARY OF THE DISCLOSURE

Therefore, an object of the present disclosure is to provide a liquid ejection apparatus having a small liquid ejection head capable of switching a liquid circulation flow passage.

A liquid ejection device comprising: a first flow passage and a second flow passage for supplying or collecting liquid to an element substrate for ejecting liquid; a circulation supply flow passage for supplying liquid to or from the first flow passage or the second flow passage; a circulation recovery flow passage for collecting liquid from the first flow passage or the second flow passage; and a plurality of on-off valve mechanisms for controlling communication and shutoff between the respective flow passages; wherein the on-off valve mechanism comprises an opening located between the flow passages; a sealing portion capable of opening and closing the opening; an urging member for urging the sealing portion toward or away from the opening; and a movement mechanism for moving the sealing portion against the urging force of the urging member. The on-off of the at least two on-off valve mechanisms is controlled by moving the sealing parts of the at least two on-off valve mechanisms together by the movement mechanism.

Further features of the present disclosure will become apparent from the following description of exemplary of embodiments with reference to the attached drawings.

DESCRIPTION OF THE EMBODIMENTS

Embodiments of the present disclosure will be described below with reference to the drawings. However, the embodiments described below are not intended to limit the present disclosure. For example, in each of the embodiments described below, a liquid ejection head of a thermal system for ejecting a liquid by generating bubbles by a heating element is employed, but the present disclosure can also be applied to a liquid ejection head employing a piezo system or other various liquid ejection systems.

First Embodiment (Description of Liquid Ejection Apparatus)

Figure 1A:
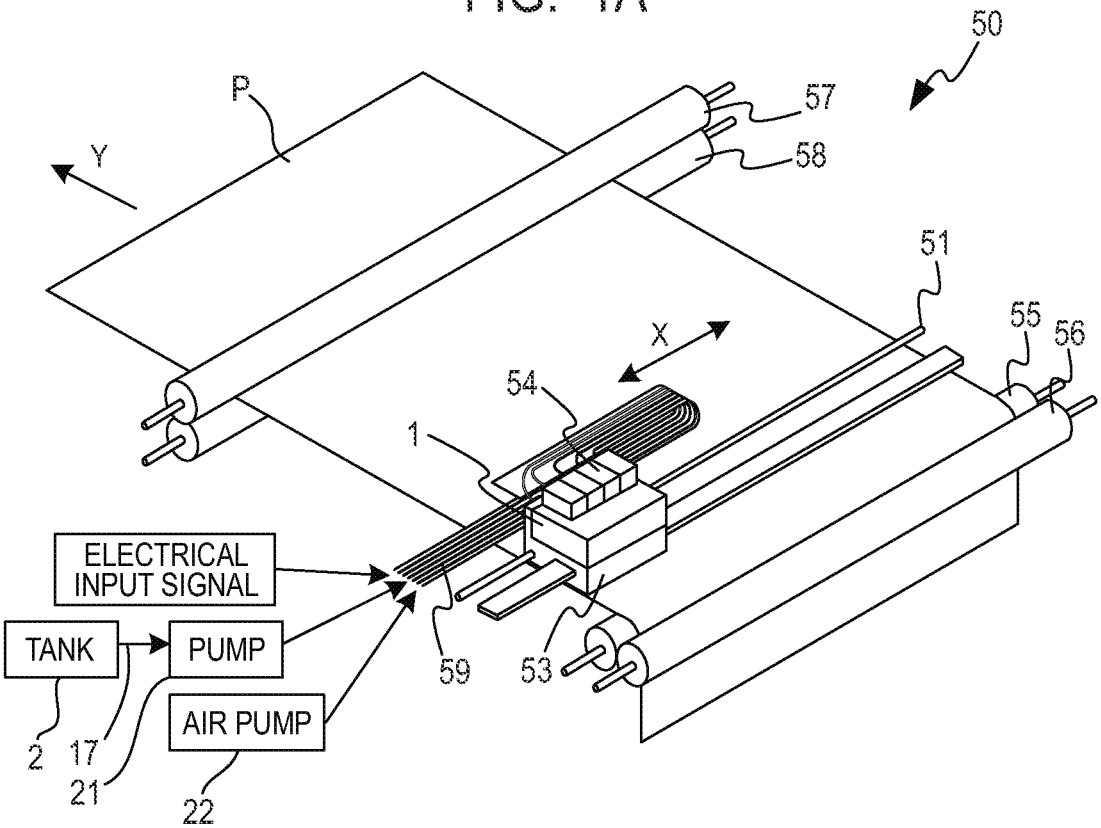
FIG. 1A is a schematic perspective view of a main part of a liquid ejection apparatus according to a first embodiment of the present disclosure.
Figure 1B:
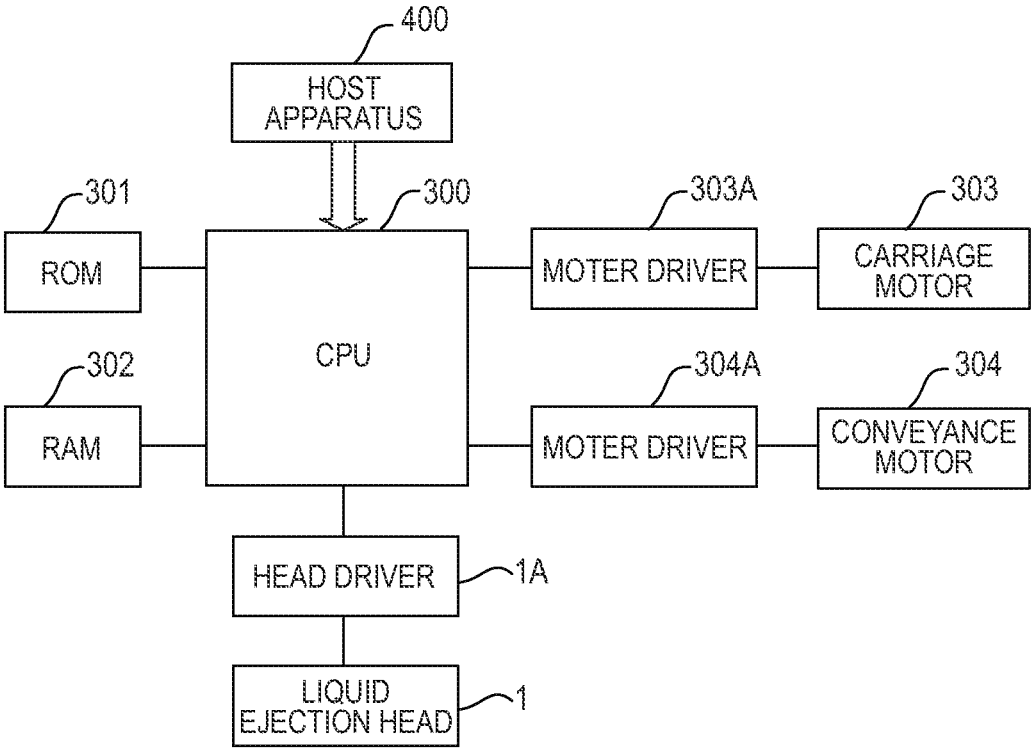
FIG. 1B is a block diagram of a main part of a liquid ejection apparatus according to a first embodiment of the present disclosure.

A liquid ejection apparatus according to a first embodiment of the present disclosure will be described with reference to FIGS. 1A to 6E. FIG. 1A is a schematic perspective view of a main part of a liquid ejection apparatus 50 including a liquid ejection head 1 of the first embodiment, and FIG. 1B is a block diagram of a control system of the liquid ejection apparatus 50. The liquid ejection apparatus 50 of the present embodiment is an ink jet recording apparatus of a serial scanning method that ejects liquid such as ink from the liquid ejection head 1 and records images, characters, patterns, etc., on a recording medium P, and the liquid ejection head 1 is an ink jet recording head. The liquid ejection head 1 is mounted on a carriage 53, and the carriage 53 is driven by a carriage motor 303 (see FIG. 1B) and is movable in a main scanning direction (direction of arrow X in FIG. 1A) along a guide shaft 51. A guide 59 is connected to the carriage 53. The guide 59 includes electric wiring and pipes, and electric signals, liquid and air necessary for ejecting the liquid are supplied to the carriage 53 via the guide 59. The liquid ejection apparatus 50 has conveyance rollers 55, 56, 57 and 58.

The conveying rollers 55, 56, 57 and 58 are driven by a conveying motor 304 (see FIG. 1B) and can convey the recording medium P in a sub-scanning direction (arrow Y direction in FIG. 1A) that intersects the main scanning direction (orthogonal in this embodiment).

The liquid ejection head 1 can perform full-color printing using four colors of liquid (ink) of C (cyan), M (magenta), Y (yellow) and K (black). An energy generating element provided in the liquid ejection head 1 is driven by a head driver 1A (see FIG. 1B) in accordance with an electric signal inputted from an electric wiring board 6 (see FIG. 2), and generates energy for ejecting a liquid from an ejection port. The liquid ejection head 1 has a liquid circulation unit 54, and the liquid circulation unit 54 circulates the liquid through an element substrate 200 to be described later.

In the liquid ejection apparatus 50, a cap member (not shown) is disposed at a position which can face the ejection port forming surface of the liquid ejection head 1 and which is away from the conveying passage of the recording medium P. When recording on the recording medium P is not performed, the cap member is relatively moved to a position covering the ejection port forming surface of the liquid ejection head 1, and drying of the discharge port is suppressed, and suction is performed for filling of the liquid and recovery operation s.

As shown in FIG. 1B, the liquid ejection apparatus 50 comprises a CPU (control unit) 300, a ROM 301, and a RAM 302. The CPU 300 controls each part of the liquid ejection apparatus 50 based on a program such as a processing procedure stored in the ROM 301, and the RAM 302 is used as a work area or the like for executing these processes. The CPU 300 controls the head driver 1A based on image data sent from a host device (computer) 400 external to the liquid ejection apparatus 50. The CPU 300 also controls the carriage motor 303 via the motor driver 303A to move the carriage 53, and controls the conveyance motor 304 via the motor driver 304A to convey the recording medium P.

(Description of Liquid Ejection Head)

Figure 2:
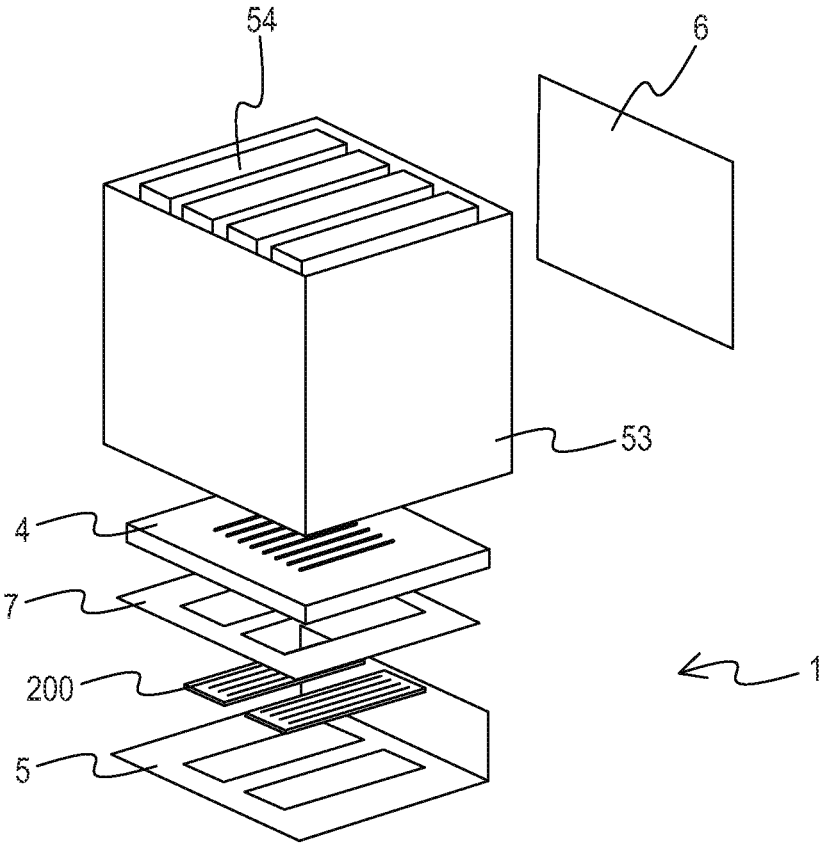
FIG. 2 is an exploded perspective view of the liquid ejection head of the liquid ejection apparatus shown in FIG. 1A and FIG. 1B.
Figure 3:
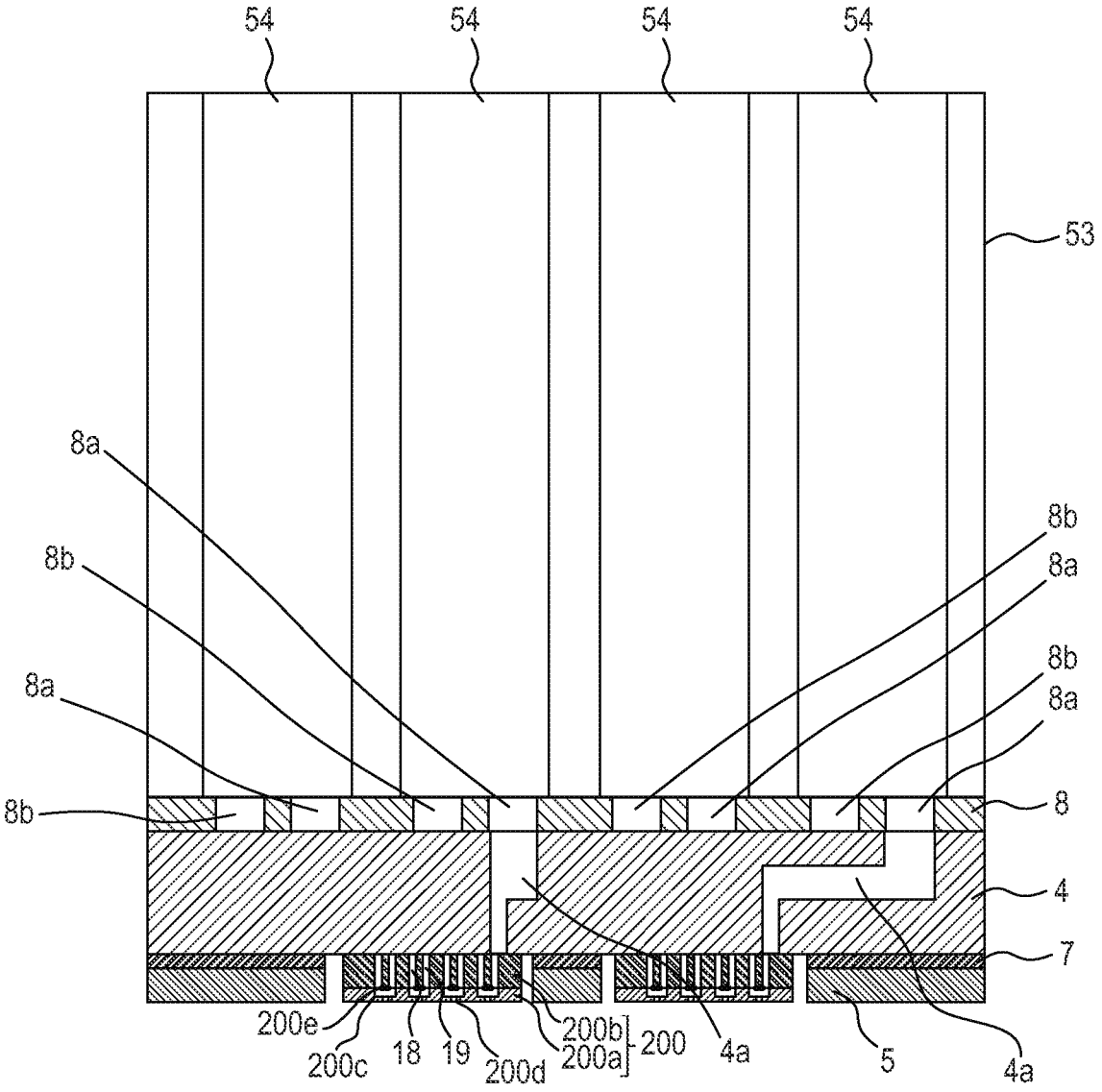
FIG. 3 is a cross-sectional view showing a flow passage of the liquid ejection apparatus shown in FIG. 1A and FIG. 1B.

FIG. 2 is an exploded perspective view showing the liquid ejection head 1 of the first embodiment. FIG. 3 is a cross-sectional view showing a flow passage of the liquid ejection apparatus. The liquid ejection head 1 includes a liquid circulation unit 54 and a discharge unit. The ejection unit mainly comprises an element substrate 200, an electric wiring member 5, an electric wiring substrate 6, a first support member 4, and a second support member 7, and ejects recording liquid (ink) supplied from the liquid circulation unit 54 onto the recording medium P. The liquid ejection head 1 is fixedly supported on the carriage 53 by a positioning member and an electric contact (not shown). The liquid ejection head 1 performs recording by ejecting liquid onto the recording medium P while being scanned in the scanning direction (arrow X direction in FIG. 1A) together with the carriage 53.

As schematically shown in FIG. 1A, the liquid ejection apparatus 50 comprises a tank 2 for storing liquid, a liquid supply tube 17 connected to the tank 2, and a pump 21 provided in the middle of the liquid supply tube 17. The liquid supply tube 17 forms a part of the guide 59. A liquid connector (not shown) is provided at an end portion of the liquid supply tube 17 opposite to the connection portion with the tank 2. When a liquid ejection head 1 is mounted on a carriage 53 of a liquid ejection apparatus 50, a liquid connector and a connector insertion port (not shown) provided in a housing of the liquid ejection head 1 are airtightly connected. By the action of the pump 21, the liquid in the tank 2 is supplied to the liquid ejection head 1 through the liquid supply tube 17. The liquid ejection head 1 of the present embodiment is capable of ejecting four kinds of liquids, and a liquid supply tube 17 and a connector insertion port are provided corresponding to each liquid, and a supply passage is formed for each liquid.

As shown in FIG. 2, the ejection unit of the liquid ejection head 1 includes two element substrates (ejection modules) 200, a first support member 4, a second support member 7, an electric wiring member (electric wiring tape) 5, and an electric wiring substrate 6. The element substrate 200 is made of a silicon substrate having a thickness of 0.5 to 1 mm, and specifically, as shown in FIG. 3, comprises an ejection port forming member 200*a* and a substrate 200*b* overlapping the ejection port forming member 200*a*. The ejection port forming member 200*a* is provided with a plurality of recesses forming a pressure chamber 200*c* between itself and the substrate 200*b*, and a plurality of discharge ports 200*d* communicating with the respective pressure chambers 200*c* and opening to the outside. The substrate 200*a* is arranged corresponding to each pressure chamber 200*b*, and is provided with a plurality of energy generating elements 200*d* generating energy used for ejecting liquid. In this embodiment, a heating resistance element (heater) is used as the energy generating element 200*d*, and electric wiring (not shown) for supplying electric power to each energy generating element 200*d* is formed on the substrate 200*a* by a film forming technique. Further, the substrate 200*b* is provided with an individual supply passage 18 and an individual recovery passage 19 which are through-holes communicating with the respective pressure chambers 200*c*. The flow passages, the recesses, the discharge ports and the like of the discharge port forming member 200*a* and the substrate 200*b* can be formed by photolithography.

The element substrate 200 is adhered and fixed to a first support member 4 having a liquid supply passage and a liquid recovery passage. The first support member 4 is provided with a liquid supply passage and a liquid recovery passage for each type (color) of liquid ejected from the liquid ejection head 1. Although there arc two liquid supply passages 4*a* in the cross section shown in FIG. 3, there are other liquid supply paths and liquid recovery paths at cross section positions different from those in FIG. 3. A plurality of liquid circulation units 54 are connected to the first support member 4 via a joint member 8 having a supply hole 8*a* and a recovery hole 8*b*. In this embodiment, four liquid circulation units 54 are provided to use four colors of liquid, four supply holes 8*a* and four recovery holes 8*b* are provided in the joint member 8, and four liquid supply passages 4*a* and four liquid recovery passages (not shown) are provided in the first support member 4. The width of the liquid supply passage 4*a* and the liquid recovery passage varies from a narrow portion communicating with the pressure chamber 200*c* to a wide portion communicating with the supply hole 8*a* and the recovery hole 8*b* with a width similar to that of the supply hole 8*a* and the recovery hole 8*b*. For each color of liquid, a circulation passage is formed which extends from the liquid circulation unit 54 through the supply hole 8*a*, the liquid supply passage 4*a*, and the individual supply flow passage 18 to the pressure chamber 200*c*, and returns from the pressure chamber 200*c* through the individual recovery flow passage 19, the liquid recovery passage, and the recovery hole 8*b* to the liquid circulation unit 54. When the liquid is circulated in the forward direction, which will be described later, the liquid is circulated in this manner. However, when the liquid is circulated in the reverse direction, the liquid flows in the reverse direction. That is, the liquid circulates from the liquid circulation unit 54 to the pressure chamber 200*c* through the recovery hole 8*b*, the liquid recovery passage and the individual recovery passage 19, and to return to the liquid circulation unit 54 from the pressure chamber 200*c* through the individual supply passage 18, the liquid supply passage 4*a* and the supply hole 8*a*.

A second support member 7 is joined to the first support member 4. The second support member 7 is provided with an opening, in which the element substrate 200 is located, and the element substrate 200 and the second support member 7 do not overlap each other. The second support member 7 holds the electric wiring member 5. The electric wiring member 5 is electrically connected to the element substrate 200, and applies an electric signal for liquid ejection to the element substrate 200. Although not shown, the electrical connection portion between the element substrate 200 and the electrical wiring member 5 is sealed with a sealing material to protect it from corrosion by a liquid (e.g., ink) and impact from the outside. The electric wiring board 6 is thermally compressed via an anisotropic conductive film (not shown) and electrically connected to the end portion of the electric wiring member 5 opposite to the connection portion with the element board 200. The electric wiring board 6 has an external signal input terminal (not shown) for receiving an electric signal from the CPU 300 of the liquid ejection apparatus body.

With the above-described configuration, the liquid is supplied from the tank 2 to the liquid circulation unit 54 by the action of the pump 21, and further supplied to the pressure chamber 200*c* via the supply hole 8*a*, the liquid supply passage 4*a*, and the individual supply passage 18. Then, an electric signal is selectively applied from the CPU 300 to the energy generating element 200*e* of the element substrate 200 via the electric wiring board 6 and the electric wiring member 5. An energy generating element 200*e* to which an electric signal is applied generates energy for liquid ejection, for example, thermal energy. The liquid in the pressure chamber 200*c* is foamed by receiving energy, and liquid droplets are ejected from an ejection port 200*d* by foaming pressure.

In this configuration, since the energy generating element 200*e* generates thermal energy to foam the liquid at the time of ejecting the liquid, the temperature of the liquid ejecting head 1 rises. In particular, in the liquid ejection apparatus 50 using ink having a small amount of moisture as a liquid for the purpose of improving color development and shortening drying time, bubbles are generated and easy to grow due to precipitation of dissolved oxygen in the liquid. For example, when bubbles grow in the individual recovery passage 19 shown in FIG. 3, the bubbles can be discharged by being placed on the liquid circulation flow. However, when the bubbles grow in the individual supply passage 18, the bubbles advance together with the liquid toward the pressure chamber 200*c* and the discharge port 200*d*, and the liquid may become insufficient in the pressure chamber 200*c*, especially in the vicinity of the discharge port 200*d*, and the liquid may not be discharged. Although it is possible to avoid this problem by degassing the liquid in the above-described liquid circulation passage, the degassing mechanism increases the size of the liquid ejection apparatus 50 and the cost. Therefore, in the present embodiment, the liquid is discharged without deaeration, and the liquid is circulated in the opposite direction before the bubble grows and cannot be discharged. As aresuly, the bubbles in the individual supply passage 18 are returned to the liquid circulation unit 54 side, and the bubbles are moved to a place where the liquid ejection is not affected, and the above-mentioned problem can be avoided.

(Description of Liquid Circulation Passage)

Figure 4A:
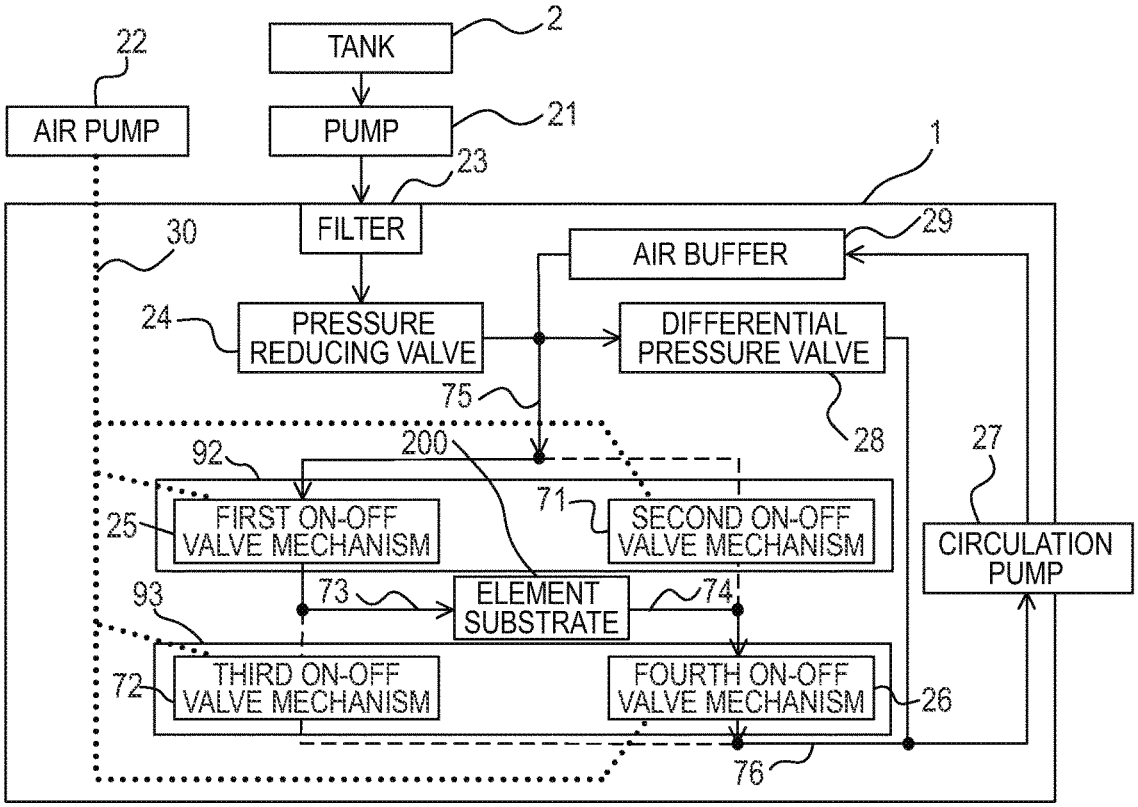
FIG. 4A is a block diagram showing a flow passage of the liquid ejection apparatus shown in FIG. 1A and FIG. 1B.
Figure 4B:
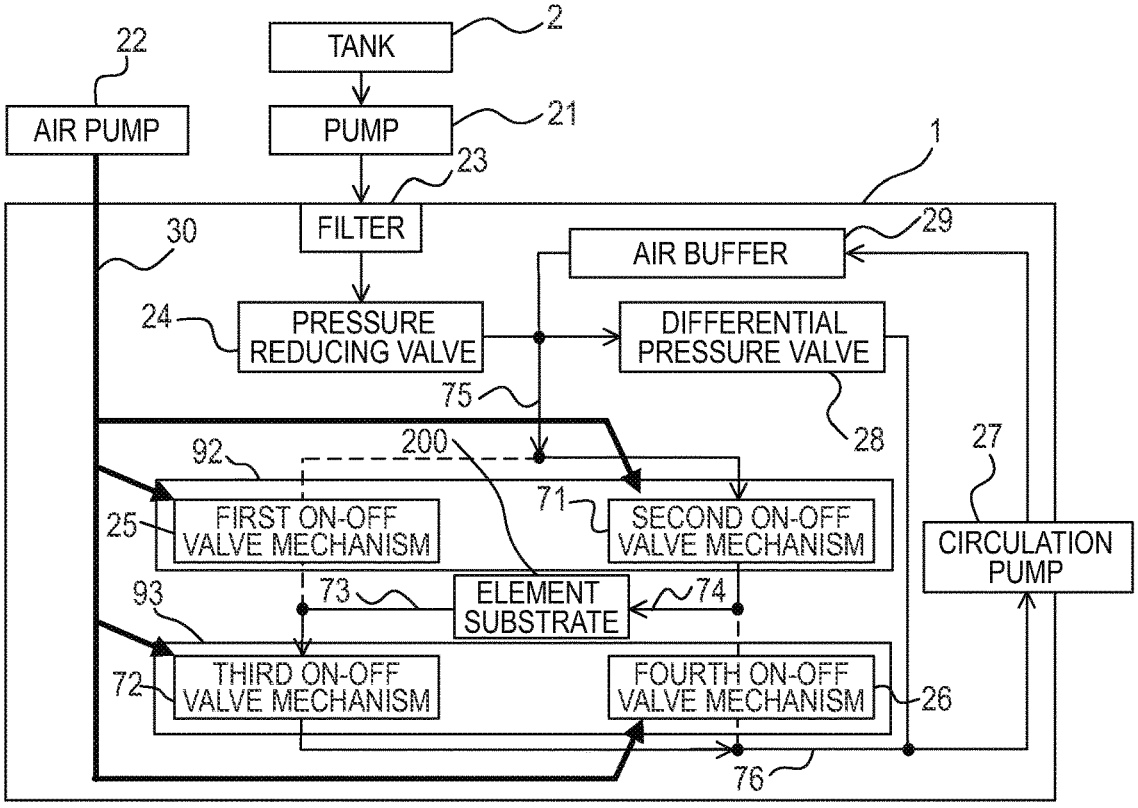
FIG. 4B is a block diagram showing a flow passage of the liquid ejection apparatus shown in FIG. 1A and FIG. 1B.

FIGS. 4A and 4B are schematic diagrams showing a circulation passage of one type (one color) of liquid in the liquid ejection apparatus of this embodiment. FIG. 4A shows a circulation passage in the forward direction passage, and FIG. 4B shows a circulation passage in the reverse circulation passage. Here, the forward direction means a direction in which the liquid circulates in a normal liquid ejecting operation, and is arbitrarily set based on the bubble releasing property, the easiness of filling, the temperature distribution at the time of ejecting the liquid, and the like.

The reverse direction is a direction opposite to the forward direction and is a direction of liquid circulation for discharging bubbles or the like when the liquid is not discharged. In the liquid ejection head 1 for ejecting liquid of multiple colors (for example, four colors as shown in FIGS. 1A to 2, circulation passages as shown in FIGS. 4A and 4B are provided corresponding to the number of liquids.

In FIGS. 4A and 4B, a supply hole 8*a* and a liquid supply passage 4*a* for supplying liquid to the element substrate 200 in the forward direction are shown as a first flow passage 73, and a liquid recovery passage and a recovery hole 8*b* for recovering liquid from the element substrate 200 are shown as a second flow passage 74. In this embodiment, four on-off valve mechanisms 25, 26, 71 and 72 are provided in the liquid circulation passage. That is, the circulation supply flow passage 75 and the circulation recovery flow passage 76 which are a part of the liquid circulation unit 54 are connected to the first flow passage 73 and the second flow passage 74 through the on-off valve mechanisms 25, 26, 71 and 72, respectively. A first on-off valve mechanism 25 is provided in a liquid passage comprising a circulation supply passage 75 and a first passage 73, and a second on-off valve mechanism 71 is provided in a liquid passage comprising a circulation supply passage 75 and a second passage 74. A third on-off valve mechanism 72 is provided in a liquid passage comprising a circulation recovery passage 76 and a first passage 73, and a fourth on-off valve mechanism 26 is provided in a liquid passage comprising a circulation recovery passage 76 and a second passage 74. These on-off valve mechanisms 25, 26, 71 and 72 control communication and interruption between the respective flow passages. That is, by opening and closing the on-off valve mechanisms 25, 26, 71 and 72, the connection between the circulation supply flow passage 75 and the circulation recovery flow passage 76 and the connection between the first flow passage 73 and the second flow passage 74 can be individually controlled and the circulation direction of the liquid can be switched.

Specifically, by opening the first on-off valve mechanism 25 and the fourth on-off valve mechanism 26, and closing the second on-off valve mechanism 71 and the third on-off-valve mechanism 72, the liquid is circulated in forward direction (see FIG. 4A). On the other hand, by opening the second on-off valve mechanism 71 and the third on-off valve mechanism 72 and closing the first on-off valve mechanism 25 and the fourth on-off valve mechanism 26, the liquid is circulated in the reverse direction (see FIG. 4B).

When liquid is ejected by the liquid ejection head of this embodiment, the liquid is pressurized and supplied from the tank 2 to the liquid ejection head 1 by the operation of the pump 21. Dust in the liquid pressure-supplied to the liquid ejection head 1 is removed by a filter 23, and after the pressure of the liquid is adjusted by a pressure reducing valve 24, the liquid flows into a circulation supply passage 75. As described above, with the first on-off valve mechanism 25 and the fourth on-off valve mechanism 26 open and the second on-off valve mechanism 71 and the third on-off valve mechanism 72 closed, liquid is supplied from the first flow passage 73 to the element substrate 200. When an electric signal is applied to the energy generating element 200*e* provided in the pressure chamber 200*c* of the element substrate 200 shown in FIG. 3, the liquid is discharged from the discharge port 200*d*. The liquid not discharged in the pressure chamber 200*b* is recovered from the second flow passage 74 to the circulation recovery flow passage 76. A circulation pump 27 is connected to the circulation recovery flow passage 76, and liquid flows from the circulation recovery flow passage 76 to the circulation supply flow passage 75 through an air buffer 29 by the circulation pump 27. In this way, the liquid is circulated in the forward direction. The air buffer 29 located downstream of the circulation pump 27 reduces pressure fluctuations associated with pump pulsations and temperature rises, thereby contributing to stabilization of ejection and suppression of ink leakage. A differential pressure valve 28 is provided between the pressure reducing valve 24 and the circulation recovery flow passage 76. The differential pressure valve 28 suppresses, for example, the influence on the discharge due to the pressure drop when the liquid is discharged from all the discharge ports 200*d*.

In this way, while the liquid is discharged from the liquid ejection head 1 while the liquid is circulated in the forward direction shown in FIG. 4A, when bubbles are generated in the circulation passage of the liquid, the circulation direction of the liquid is switched in order to discharge the bubbles. That is, while the liquid is not ejected, the air pump 22 is driven to supply pressurized air to the pneumatic drive passage 30 as shown in FIG. 4B, the second on-off valve mechanism 71 and the third on-off valve mechanism 72 are opened, and the first on-off valve mechanism 25 and the fourth on-off valve mechanism 26 are closed. In this state, when the pump 21 is operated, the liquid flowing from the tank 2 into the circulation recovery flow passage 76 of the liquid ejection head 1 is supplied from the second flow passage 74 to the pressure chamber 200*c* of the element substrate 200. The liquid in the pressure chamber 200*c* is recovered from the first flow passage 73 to the circulation supply flow passage 75. In this way, circulation of the liquid in the reverse direction is performed. When bubbles or the like exist particularly in the circulation supply flow passage 75 and the first flow passage 73 by the circulation of the liquid in the reverse direction, the bubbles are moved away from the pressure chamber 200*c* and the ejection port 200*d* and the liquid is prevented from the non-ejection of the liquid. When bubbles or the like exist in the circulation and recovery passage 76 and the second passage 74, the bubbles are moved away from the pressure chamber 200*c* and the discharge port 200*d* by the forward liquid circulation accompanying the normal liquid ejection. In the liquid circulation in the forward direction accompanying the normal liquid ejection, when bubbles are generated in the circulation supply passage 75 and the first passage 73 approaching the pressure chamber 200*c* and the discharge port 200*d*, the liquid is circulated in the reverse direction, and the bubbles are moved away from the pressure chamber 200*c* and the discharge port 200*d*.

As will be described later, the on-off valve mechanisms 25, 26, 71 and 72 of the present embodiment can be driven by air pressure, and can be switched with less vibration than a solenoid valve. The air pump 22 supplies pressurized air to the pneumatic drive passage 30 to control opening and closing of the four on-off valve mechanisms 25, 26, 71 and 72. When the circulation passage in the reverse direction of the liquid is configured, it is necessary to return the four on-off valve mechanisms 25, 26, 71 and 72 to the normal positions in order to return the liquid to the circulation passage in the forward direction before ejecting the liquid. For this reason, each of the on-off valve mechanisms 25, 26, 71 and 72 must be capable of being opened to the atmosphere. Therefore, in the present embodiment, the three-way valves 92 and 93 having a configuration in which a plurality of on-off valve mechanisms are substantially integrated are used to switch between a pressurized air supply state from the air pump 22 and an atmosphere open state. For example, two three-way valves having a structure integrating two on-off valve mechanisms are arranged. Specifically, a first three-way valve 92 integrated with the first and second on-off valve mechanisms 25 and 71, and a second three-way valve 93 integrated with the third and fourth on-off valve mechanisms 72 and 26 are provided. This makes it possible to realize a configuration including the four on-off valve mechanisms 25, 26, 71 and 72 as described above. For example, the first three-way valve 92 includes a first on-off valve mechanism 25 and a second on-off valve mechanism 71, and opens one of the first on-off valve mechanism 25 and the second on-off valve mechanism 71 and simultaneously closes the other. The second three-way valve 93 includes a third on-off valve mechanism 72 and a fourth on-off valve mechanism 26, and opens one of the third on-off valve mechanism 72 and the fourth on-off valve mechanism 26 and simultaneously closes the other. FIGS. 4A and 4B show a configuration in which the pneumatic drive flow passage 30 supplies air to each of the on-off valve mechanisms 25, 26, 71 and 72 for easy understanding, but as will be described later, air may be supplied to a pressure chamber 200*c* having a smaller number of on-off valve mechanisms 25, 26, 71 and 72.

Figure 5A:
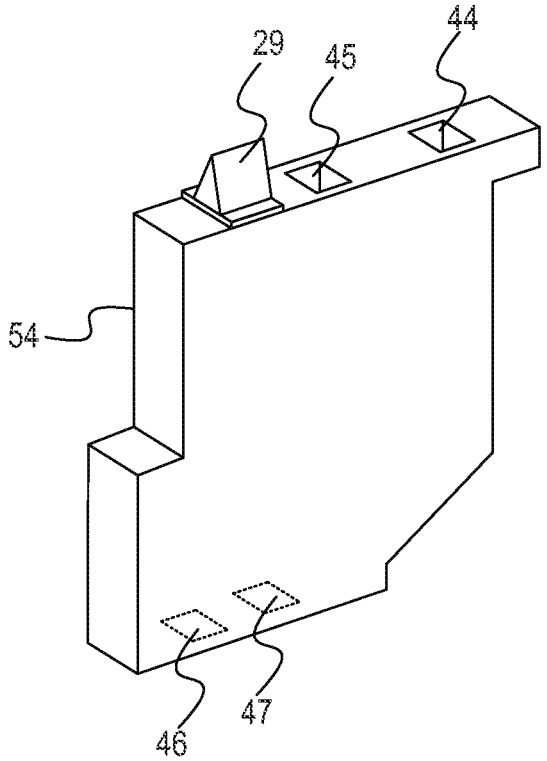
FIG. 5A is a perspective view of a liquid circulation unit of the liquid ejection apparatus shown in FIG. 1A and FIG. 1B.
Figure 5B:
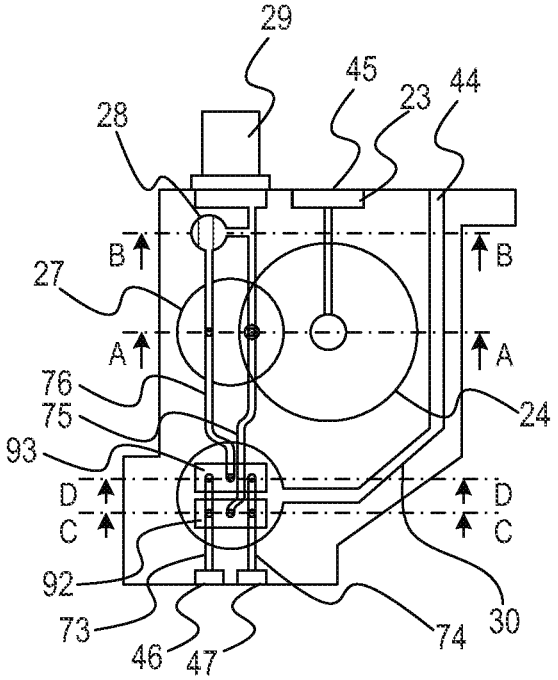
FIG. 5B is a front view of a liquid circulation unit of the liquid ejection apparatus shown in FIG. 1A and FIG. 1B.
Figure 5C:
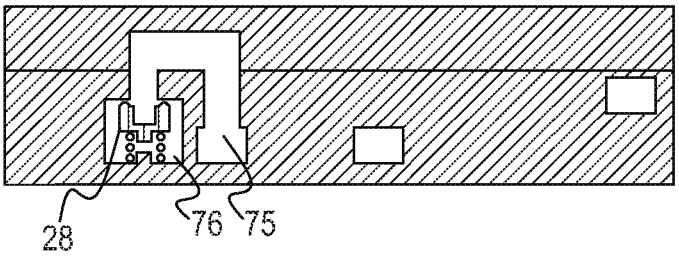
FIG. 5C is a cross-sectional view of a liquid circulation unit of the liquid ejection apparatus shown in FIG. 1A and FIG. 1B.
Figure 5D:
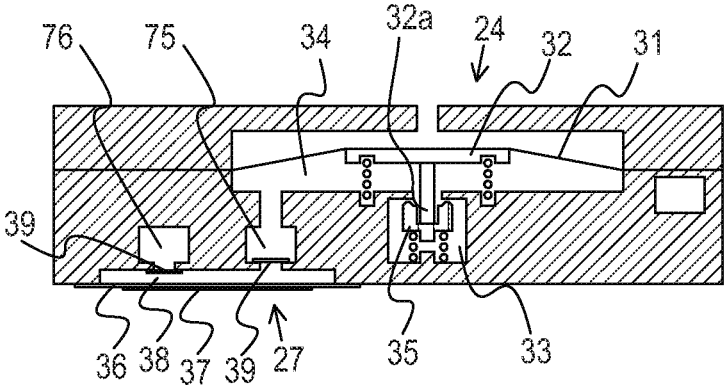
FIG. 5D is a cross-sectional view of a liquid circulation unit of the liquid ejection apparatus shown in FIG. 1A and FIG. 1B.

The detailed configuration of the liquid circulation unit 54 of this embodiment is shown in FIGS. 5A to 5D. FIG. 5A is a schematic perspective view of a liquid circulation unit 54 for one color. FIG. 5B is a plan view partially passing through it. FIG. 5C is a cross-sectional view taken along line A-A of FIG. 5B. FIG. 5D is a cross-sectional view taken along line B-B of FIG. 5B. The liquid circulation unit 54 is provided with the main parts of the circulation passage and the circulation mechanism shown in FIGS. 4A and 4B.

As shown in FIGS. 5A and 5B, an inflow port 45 of a liquid circulation unit 54 serving as an inlet from a tank 2 to a liquid ejection head 1 is connected to a primary side liquid chamber 33 (see FIG. 5D) of a pressure reducing valve 24 for negative pressure adjustment via a filter 23. As shown in FIG. 5D, the pressure reducing valve 24 has a primary side liquid chamber 33 and a secondary side liquid chamber 34, and a valve mechanism 35 is provided at a communicating portion between the primary side liquid chamber 33 and the secondary side liquid chamber 34. A part of a wall defining the secondary side liquid chamber 34 is made of a flexible film 31, and a convex part 32*a* provided on a pressure receiving plate 32 fixed to the flexible film 31 constitutes a valve rod of the valve mechanism 35. Therefore, when the liquid supplied from the inflow port 45 to the primary side liquid chamber 33 through the filter 23 flows into the secondary side liquid chamber 34, the flexible film 31 is pushed by the flowing liquid and the pressure receiving plate 32 moves while bending and deforming. Accordingly, the convex portion (valve rod) 32*a* moves forward and backward between the primary liquid chamber 33 and the secondary liquid chamber 34, and the degree of opening of the valve mechanism 35 is adjusted. A circulation supply passage 75 is connected to the secondary side liquid chamber 34 of the pressure reducing valve 24. An ejection side of the circulation pump 27 is connected to the circulation supply passage 75. A circulation recovery flow passage 76 is connected to the suction side of the circulation pump 27. The circulating pump 27 is a piezoelectric diaphragm pump in which, when a driving voltage is applied to a piezoelectric element 37 stuck to a diaphragm 36, the volume of a pump chamber 38 changes, and two check valves 39 on an ejection side and a suction side move alternately due to pressure fluctuation to send liquid. The ejection side of the circulation pump 27 is connected to the secondary side liquid chamber 34 of the pressure reducing valve 24 and also communicated with the air buffer 29. A part of the air buffer 29 is made of rubber, and pressure fluctuation can be absorbed by deformation of the rubber.

A circulation supply passage 75 connected to the discharge side of the circulation pump 27 is provided with a first three-way valve 92. A circulation recovery flow passage 76 connected to the suction side of the circulation pump 27 is provided with a second three-way valve 93. The two three-way valves 92 and 93 of the present embodiment are shown in FIG. 3. Although the details will be described later, the first three-way valve 92 and the second three-way valve 93 can switch the flow passage by air pressure, and are driven by pressurized air supplied from an air pump 22 (See FIGS. 4A and 4B) of the apparatus main body to the air supply port 44 and the air pressure drive flow passage 30. The first three-way valve 92 has the functions of the first on-off valve mechanism 25 and the second on-off valve mechanism 71 in FIGS. 4A and 4B so as to allow the liquid supplied from the circulation supply flow passage 75 to flow to the first flow passage 73 or the second flow passage 74. The second three-way valve 93 has the functions of the of the third on-off valve mechanism 72 and the fourth on-off valve mechanism 26 in FIGS. 4A and 4B so as to allow liquid to be collected from the first flow passage 73 or the second flow passage 74 into the circulation recovery flow passage 76. The first flow passage 73 is connected from the supply connection port 46 to the supply hole 8*a* of the joint member 8, and the second flow passage 74 is connected from the recovery connection port 47 to the recovery hole 8*b* of the joint member 8. As a result, as shown in FIG. 3, the liquid circulation unit 54 is connected to the element substrate 200 to form a liquid circulation passage.

As shown in FIGS. 4A, 4B, 5B and 5C, a differential pressure valve 28 is provided between the circulation supply passage 75 and the circulation recovery passage 76. When the pressure of the circulation recovery flow passage 76 decreases due to the liquid ejection or the drive of the circulation pump 27, the differential pressure valve 28 opens to prevent the differential pressure from becoming excessively large, thereby maintaining the ejection port 200*d* at a proper negative pressure.

(Explanation of Three-Way Valve)

Figure 6A:
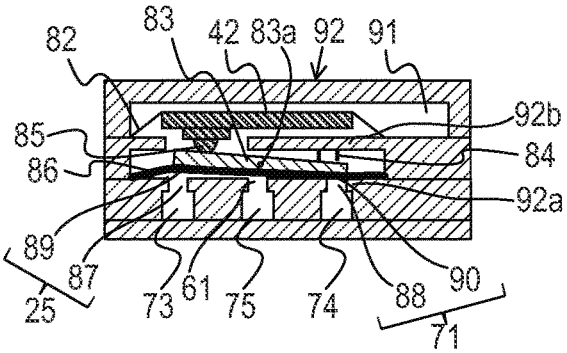
FIG. 6A is a cross-sectional view of a three-way valve according to a first embodiment of the present disclosure.
Figure 6B:
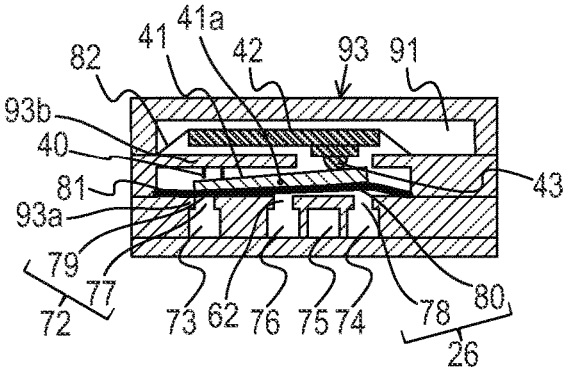
FIG. 6B is a cross-sectional view of a three-way valve according to a first embodiment of the present disclosure.
Figure 6C:
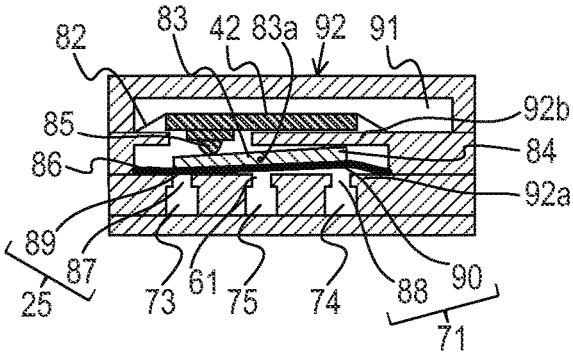
FIG. 6C is a cross-sectional view of a three-way valve according to a first embodiment of the present disclosure.
Figure 6D:
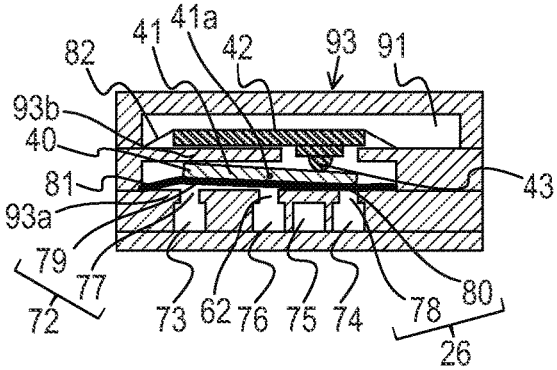
FIG. 6D is a cross-sectional view of a three-way valve according to a first embodiment of the present disclosure.
Figure 6E:
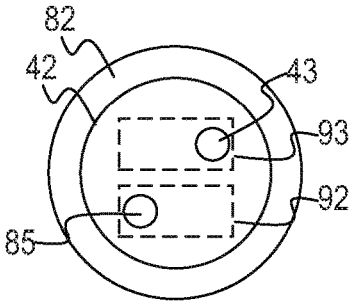
FIG. 6E is a front view of a three-way valve according to a first embodiment of the present disclosure.

FIGS. 6A to 6E schematically show the movement of the three-way valves 92 and 93. FIGS. 6A and 6C are cross-sectional views taken along C-C of FIG. 5B showing a first three-way valve 92. FIGS. 6B and 6D are cross-sectional views taken along line D-D of FIG. 5B showing a second three-way valve 93. FIG. 6E is a front view showing an area including two three-way valves 92 and 93. As described above, the first three-way valve 92 has functions as a first on-off valve mechanism 25 and a second on-off valve mechanism 71. Specifically, the first opening 87 and the first sealing portion 89 of the first three-way valve 92 constitute the first on-off valve mechanism 25, and the second opening 88 and the second sealing portion 90 constitute the second on-off valve mechanism 71. The first opening 87 communicates with the first flow passage 73, and the second opening 88 communicates with the second flow passage 74. An opening 61 communicating with the circulation supply passage 75 is provided between the first opening 87 and the second opening 88. A flexible film 86 as a flexible member is arranged at a position where the first opening 87, the second opening 88 and the opening 61 can be opposed to cover them. The flexible film 86 is joined to the rocker mechanism 83. A part of the flexible film 86 and the rocker mechanism 83 constitutes the first sealing part 89, and the other part constitutes the second sealing part 90. Therefore, the first sealing portion 89 and the second sealing portion 90 arc a part and another part of the same member (the flexible film 86 and the rocker mechanism 83). The rocker mechanism 83 is rotatable about the shaft 83*a*, and the first sealing portion 89 is urged in a direction away from the first opening 87 by a spring 84 serving as an urging member. The flexible film 86 is preferably formed of a rubber material having no problem in liquid contact property and gas permeability.

Similarly, the second three-way valve 93 has functions as a third on-off valve mechanism 72 and a fourth on-off valve mechanism 26. Specifically, the third on-off valve mechanism 72 is constituted by the third opening 77 and the third sealing portion 79 of the second three-way valve 93, and the fourth on-off valve mechanism 26 is constituted by the fourth opening 78 and the fourth sealing portion 80. The third opening 77 communicates with the first flow passage 73, and the fourth opening 78 communicates with the second flow passage 74. An opening 62 communicating with the circulation recovery flow passage 76 is provided between the third opening 77 and the fourth opening 78. A flexible film 81 as a flexible member is arranged at a position where the flexible film 81 can face and cover the third opening 77, the fourth opening 78 and the opening 62. The flexible film 81 is joined to the rocker mechanism 41. A part of the flexible film 81 and the rocker mechanism 41 constitutes a third sealing part 79, and the other part constitutes a fourth sealing part 80. The rocker mechanism 41 is rotatable about the shaft 41*a* and is urged by a spring 40 as an urging member in a direction in which the fourth sealing portion 80 is separated from the fourth opening 78. The flexible film 81 is preferably formed of a rubber material having no problem in liquid contact property and gas permeability.

A pressure chamber 91 is provided so as to overlap a space provided with the flexible film 86 and the rocker mechanism 83 and a space provided with the flexible film 81 and the rocker mechanism 41. A flexible film 82 as a flexible member is arranged in the pressurizing chamber, and a pressing plate 42 is joined to the flexible film 82. In the initial state shown in FIG. 6A, the pressure in the pressurizing chamber is atmospheric pressure, and no biasing force is applied to the flexible film 82 and the pressing plate 42. At this time, the first opening 87 constituting the first on-off valve mechanism 25 and the first sealing portion 89 are separated from each other, and the circulation supply flow passage 75 communicates with the first flow passage 73 to allow liquid to flow. In this case, a part of a wall defining a liquid flow passage (communication passage) for communicating the circulation supply flow passage 75 and the first flow passage 73 is formed of a flexible film 86. On the other hand, the second opening 88 constituting the second on-off valve mechanism 71 and the second sealing portion 90 are in contact with each other to be in a sealed closed state. The circulation supply passage 75 is not communicated with the second passage 74, and the liquid does not flow.

In this initial state, as shown in FIG. 6B, in the second three-way valve 93, the fourth opening 78 constituting the fourth on-off valve mechanism 26 and the fourth sealing portion 80 are separated from each other, and the circulation recovery flow passage 76 communicates with the second flow passage 74 to allow liquid to flow. At this time, a part of a wall defining a liquid flow passage (communication passage) for communicating the circulation recovery flow passage 76 and the second flow passage 74 is formed of a flexible film 81. On the other hand, the third opening 77 constituting the third on-off valve mechanism 72 and the third sealing portion 79 are in contact with each other to be in a sealed closed state. The circulation recovery flow passage 76 is not communicated with the first flow passage 73, and the liquid does not flow.

In the initial state shown in FIGS. 6A and 6B, when pressurized air from the air pump 22 is introduced into the pressurizing chamber 91, the flexible film 82 and the pressing plate 42 are moved downward in FIGS. 6A and 6B by the pneumatic pressure. As shown in FIG. 6C, the pressing portion 85 of the pressing plate 42 pushes down the rocker mechanism 83, and the rocker mechanism 83 rotates against the biasing force of the spring 84. Thus, the first sealing part 89 seals the first opening 87, and the first on-off valve mechanism 25 is closed. On the other hand, the second sealing part 90 is separated from the second opening 88 by the rotation of the rocker mechanism 83, and the circulation supply flow passage 75 and the second flow passage 74 communicate with each other to open the second on-off valve mechanism 71. As described above, the movement mechanism for driving the first three-way valve 92 mainly comprises the rocker mechanism 83, the pressing portion 85, the pressing plate 12, and the flexible film 82, and the first on-off valve mechanism 25 and the second on-off valve mechanism 71 are simultaneously driven by the movement mechanism. The regulating portions 92*a* and 92*b*, which are portions of walls defining a space in which the rocker mechanism 83 is accommodated and which are located above and below the rocker mechanism 83, define a range of rotational motion about the shaft 83*a* of the rocker mechanism 83. That is, in the state shown in FIG. 6A, the rocker mechanism 83 is held by the restricting portion 92*a* at a position where the second sealing portion 90 closes the second opening 88. In the state shown in FIG. 6B, the rocker mechanism 83 is held by the regulating portion 92*b* at a position where the first sealing portion 89 closes the first opening 87, and the rocker mechanism 83 is regulated from rotating excessively.

When the flexible film 82 and the pressing plate 42 move downward in FIG. 6B, as shown in FIG. 6D, the pressing portion 43 of the pressing plate 42 pushes down the rocker mechanism 41, and the rocker mechanism 41 rotates against the biasing force of the spring 40. Thereby, the fourth sealing part 80 seals the fourth opening 78, and the fourth on-off valve mechanism 26 is closed. On the other hand, the third sealing part 79 is separated from the third opening 77 by the rotation of the rocker mechanism 41, and the circulation recovery flow passage 76 and the first flow passage 73 are communicated with each other to open the third on-off valve mechanism 72. The movement mechanism for driving the second three-way valve 93 mainly comprises a rocker mechanism 41, a pressing part 43, a pressing plate 42, and a flexible film 82, and the third on-off valve mechanism 72 and the fourth on-off valve mechanism 26 are simultaneously driven by the movement mechanism. The regulating portions 93*a* and 93*b*, which are portions of walls defining a space in which the rocker mechanism 41 is accommodated and which are located above and below the rocker mechanism 41, define a range of rotational motion about the shaft 83*a* of the rocker mechanism 41. That is, in the state shown in FIG. 6B, the rocker mechanism 41 is held by the regulating portion 93*a* at a position where the third sealing portion 79 closes the third opening 77. In the state shown in FIG. 6D, the rocker mechanism 41 is held by the regulating portion 80*b* at a position where the fourth sealing portion 80 closes the fourth opening 78, and the rocker mechanism 41 is regulated from rotating excessively.

FIG. 6E shows a pressing plate 42 constituting a movement mechanism of the first three-way valve 92 and the second three-way valve 93. The pressing plate 42 is attached to the flexible film 82 and provided with a pressing part 85 for driving the first three-way valve 92 and a pressing part 43 for driving the second three-way valve 93. Accordingly, by pressurizing the inside of the pressurizing chamber 91, the pressing plate 42 simultaneously drives the first three-way valve 92 and the second three-way valve 93. In other words, by pressurizing one pressurizing chamber 91, four on-off valve mechanisms of the first on-off valve mechanism 25, the second on-off valve mechanism 71, the third on-off valve mechanism 72, and the fourth on-off valve mechanism 26 can be simultaneously driven.

The dimensions of the three-way valves 92 and 93 are selected so that the sealing parts 89, 90, 79 and 80 can surely close the openings 87, 88, 77 and 78 and the flow resistance of the liquid flow passage (communication passage) is not excessively increased when the on-off valve mechanisms 25, 71, 72 and 26 are opened. For example, if the rocker mechanisms 83 and 41 have a length of 20 mm, a width of about 5 mm, and a height of 1 mm, the strokes of the pressing portions 85 and 43 may be about 1 mm. When the pressure in the liquid passage is −5 kPa at a maximum, the springs 84 and 40 preferably have a spring force of 0.5 N or more. Further, in the case where the pressure receiving portion of the pressing plate 42 is, for example, a circular shape having a diameter of 10 mm, when the pressure receiving portion is pressurized with a pressure of 20 kPa or more, the rocker mechanisms 83 and 41 are pressed with a force of 1.57 N or more to switch the opening and closing of the valve.

In the present embodiment, the first three-way valve 92 has functions as the first on-off valve mechanism 25 and the second on-off valve mechanism 71, and the second three-way valve 93 has functions as the third on-off valve mechanism 72 and the fourth on-off valve mechanism 26, but the present disclosure is not limited to this configuration. For example, the first three-way valve 92 may have functions of the first on-off valve mechanism 25 and the third on-off valve mechanism 72, and the second three-way valve 93 may have functions of the second on-off valve mechanism 71 and the fourth on-off valve mechanism 26.

As described above, in the liquid ejection apparatus to which the present disclosure is applied, the opening and closing of the plurality of on-off valve mechanisms 25, 71 and 72 and 26 can be controlled by one movement mechanism mainly comprising the pressure chamber 91, the flexible film 82, and the pressing plate 42. Therefore, the liquid circulation unit 54 of the liquid ejection head 1 mounted on the carriage 53 can be downsized. By using the rocker mechanisms 83 and 41, the three-way valves 92 and 93 for surely switching the opening and closing of the two opening and closing valve mechanisms can be constituted.

Second Embodiment

Figure 7A:
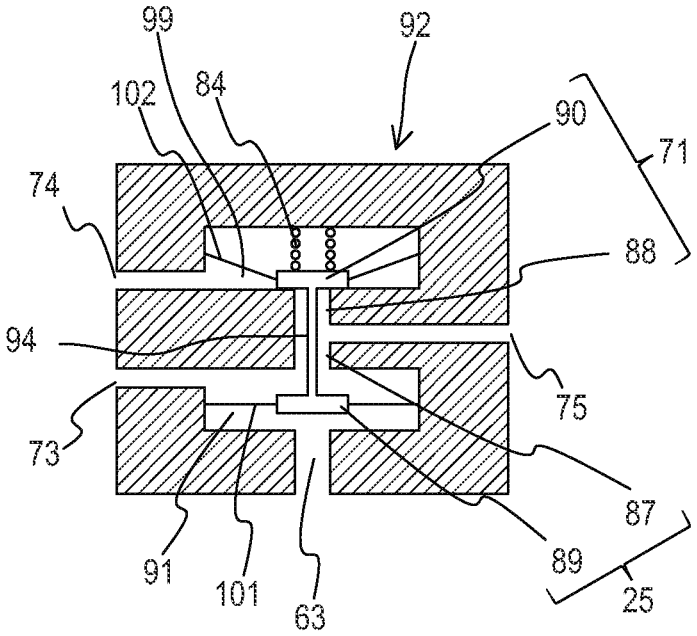
FIG. 7A is a cross-sectional view of a three-way valve according to a second embodiment of the present disclosure.
Figure 7B:
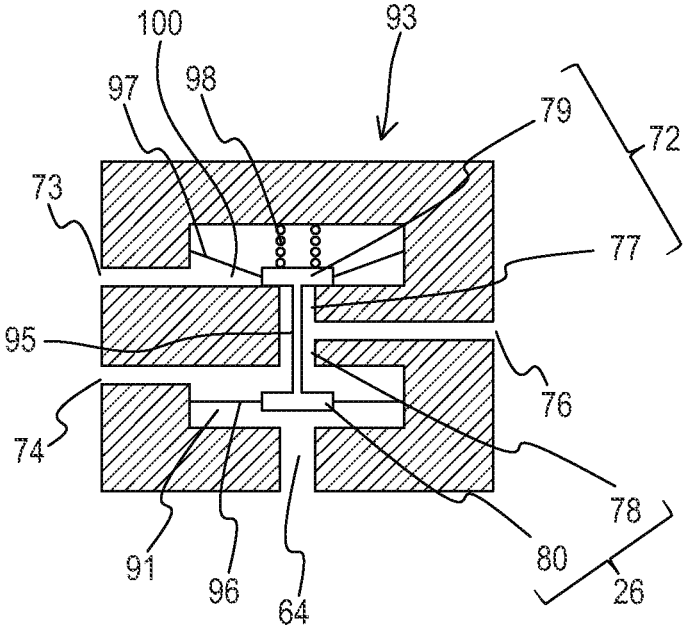
FIG. 7B is a cross-sectional view of a three-way valve according to a second embodiment of the present disclosure.

A second embodiment of the present disclosure will be described below. Since the configuration of the three-way valves 92 and 93 in this embodiment is different from that in the first embodiment, the differences will be mainly described. Since the other points are the same as those of the first embodiment, the description thereof is omitted. FIGS. 7A and 7B schematically show a first three-way valve 92 and a second three-way valve 93 of this embodiment. The first three-way valve 92 of the present embodiment shown in FIG. 7A has a first opening 87 and a second opening 88 communicating with each other from the circulation supply passage 75. The first opening 87 is connected to the first flow passage 73 via the pressurizing chamber 91. The second opening 88 is connected to the second flow passage 74 via the valve chamber 99. The pressurizing chamber 91 is provided with an external opening 63. The circulation supply passage 75, the first passage 73, the second passage 74, and the external opening 63 are opened to the outside of the first three-way valve 92.

As in the first embodiment, in the first three-way valve 92, the first opening 87 and the first sealing portion 89 constitute a first on-off valve mechanism 25, and the second opening 88 and the second sealing portion 90 constitute a second on-off valve mechanism 71. The first on-off valve mechanism 25 and the second on-off valve mechanism 71 are opposed to each other across the circulation supply flow passage 75. A first sealing part 89 located in the pressurizing chamber 91 and a second sealing part 90 located in the valve chamber 99 arc connected by a connection part 94 and can be moved integrally. A flexible film 101 is disposed in the pressurizing chamber 91, and a first sealing part 89 is attached to the flexible film 101. Similarly, a flexible film 102 is disposed in the valve chamber 99, and a second sealing portion 90 is attached to the flexible film 102. The second sealing portion 90 in the valve chamber 99 is urged by a spring 84 which is an urging member. A connection part 94 extending through the first opening 87 and the second opening 88 located between the pressurizing chamber 91 and the valve chamber 99 connects the first sealing part 89 and the second sealing part 90. The flexible film 101 forms a part of a wall defining a liquid flow passage extending from the circulation supply flow passage 75 to the first flow passage 73 through the first opening 87 and the pressurizing chamber 91. Similarly, the flexible film 102 forms a part of a wall defining a liquid flow passage extending from the circulation supply flow passage 75 to the second flow passage 74 through the second opening 88 and the valve chamber 99. The external opening 63 is opposed to the first sealing portion 89 in the pressurizing chamber 91.

The second three-way valve 93 shown in FIG. 7B has substantially the same configuration as the first three-way valve 92, and the fourth on-off valve mechanism 26 and the third on-off valve mechanism 72 face each other across the circulation recovery flow passage 76. The third opening 77, the valve chamber 100, and the third sealing portion 79 of the second three-way valve 93 have substantially the same configuration as the second opening 88, the valve chamber 99, and the second sealing portion 90 of the first three-way valve 92. The fourth opening 78, the pressurizing chamber 91, and the fourth sealing portion 80 of the second three-way valve 93 have substantially the same configuration as the first opening 87, the pressurizing chamber 91, and the first sealing portion 89 of the first three-way valve 92. A third sealing part 79 positioned in the valve chamber 100 and a fourth sealing part 80 positioned in the pressurizing chamber 91 are connected by a connection part 95 and can be moved integrally. A flexible film 97 is deposed in the valve chamber 100, and a third sealing part 79 is attached to the flexible film 97. The third sealing portion 79 in the valve chamber 100 is urged by a spring 98 which is an urging member. A flexible film 96 is disposed in the pressure chamber 91, and a fourth sealing part 80 is attached to the flexible film 96. The flexible film 96 forms a part of a wall defining a liquid flow passage extending from the circulation recovery flow passage 76 to the second flow passage 74 through the fourth opening 78 and the pressurizing chamber 91. Similarly, the flexible film 97 forms a part of a wall defining a liquid flow extending passage from the circulation recovery flow passage 76 to the first flow passage 73 through the third opening 77 and the valve chamber 100. The external opening 64 is opposed to the fourth sealing portion 80 in the pressurizing chamber 91.

In an initial state, the urging force of the spring 84 of the first three-way valve 92 is applied to the first sealing portion 89 and the second sealing portion 90 which are connected and integrated by the connecting portion 94, the first sealing portion 89 is located away from the first opening 87, and the first on-off valve mechanism 25 is opened. The second sealing portion 90 closes the second opening 88, and the second on-off valve mechanism 71 is closed. Similarly, the urging force of the spring 98 of the second three-way valve 93 is applied to the third sealing portion 79 and the fourth sealing portion 80 which are connected and integrated by the connecting portion 95, the fourth sealing portion 80 is located away from the fourth opening 78, and the fourth on-off valve mechanism 26 is opened. The third scaling portion 79 closes the third opening 77, the third on-off valve mechanism 72 is closed.

When fluid (e.g. pressurized air) flows into the external opening 63 of the first three-way valve 92 and the external opening 64 of the second three-way valve 93, the first sealing part 89 in the pressurizing chamber 91 of the first three-way valve 92 and the fourth sealing part 80 in the pressurizing chamber 91 of the second three-way valve 93 are simultaneously pressurized. When the first sealing part 89 is pressurized by the fluid, the first sealing part 89, the connecting part 94 and the second sealing part 90 are integrally moved. As a result, the first sealing part 89 closes the first opening 87, and the first on-off valve mechanism 25 is closed. At the same time, the second sealing portion 90 is separated from the second opening 88 to open the second on-off valve mechanism 71. When the fourth sealing portion 80 is pressurized by the fluid, the fourth sealing portion 80, the connecting portion 95, and the third sealing portion 79 are integrally moved. As a result, the fourth sealing portion 80 closes the fourth opening 78, the fourth on-off valve mechanism 26 is closed. At the same time, the third sealing portion 79 is separated from the third opening 77 to open the third on-off valve mechanism 72. In this manner, the four on-off valve mechanisms can be driven to switch the circulating direction of the liquid.

Also in this embodiment, it is possible to simultaneously drive the four on-off valve mechanisms 25, 71, 72 and 26 by simultaneously allowing fluid to flow into the external opening 63 of the first three-way valve 92 and the external opening 64 of the second three-way valve 93. Therefore, the liquid circulation unit 54 of the liquid ejection head 1 mounted on the carriage 53 can be further downsized. In particular, when the external opening 63 of the first three-way valve 92 and the external opening 64 of the second three-way valve 93 are adjacently arranged side by side, simultaneous driving of the four on-off valve mechanisms 25, 71, 72 and 26 by inflow of fluid can be facilitated. In the present embodiment, a rotatable rocket mechanism is not required, and the number of components is small and manufacturing is easy.

Third Embodiment

A third embodiment of the present disclosure will be described below. Since the configuration of the three-way valves 92 and 93 in this embodiment is different from that in the first and the second embodiment, the differences will be mainly described.

Figure 8A:
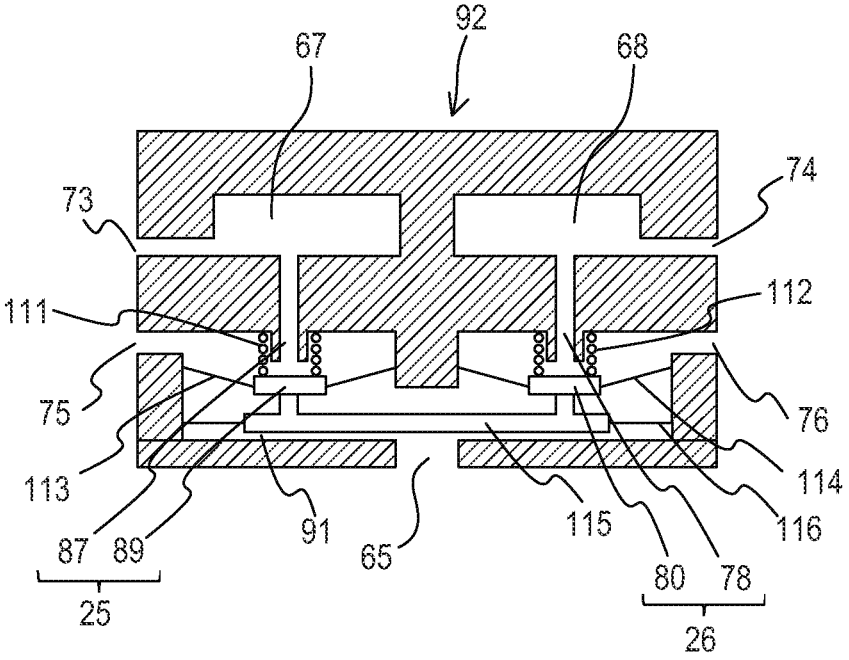
FIG. 8A is a cross-sectional view of a three-way valve according to a third embodiment of the present disclosure.
Figure 8B:
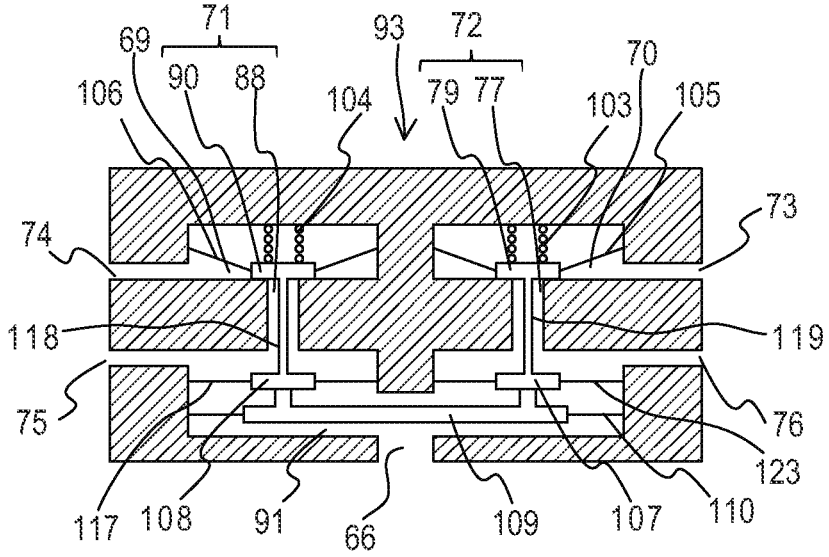
FIG. 8B is a cross-sectional view of a three-way valve according to a third embodiment of the present disclosure.

Since the other points are the same as those of the first and the second embodiment, the description thereof is omitted. FIG. 8A schematically shows a first three-way valve 92 of this embodiment, and FIG. 8B schematically shows a second three-way valve 93. The first three-way valve 92 of this embodiment constitutes a first on-off valve mechanism 25 and a fourth on-off valve mechanism 26. The second three-way valve 93 constitutes a second on-off valve mechanism 71 and a third on-off valve mechanism 72. The first three-way valve 92 includes a first on-off valve mechanism 25 and a fourth on-off valve mechanism 26, and simultaneously opens and closes the first on-off valve mechanism 25 and the fourth on-off valve mechanism 26. The second three-way valve 93 includes a second on-off valve mechanism 71 and a third on-off valve mechanism 72, and simultaneously opens and closes the second on-off valve mechanism 71 and the third on-off valve mechanism 72. That is, the first three-way valve 92 opens the first on-off valve mechanism 25 and the fourth on-off valve mechanism 26, and at the same time, the second three-way valve 93 closes the second on-off valve mechanism 71 and the third on-off valve mechanism 72. The first three-way valve 92 closing the first on-off valve mechanism 25 and the fourth on-off valve mechanism 26, and at the same time, the second three-way valve 93 opens the second on-off valve mechanism 71 and the third on-off valve mechanism 72.

The first three-way valve 92 has a pressurizing chamber 91 communicating with the circulation supply passage 75, and a first opening 87 communicating with the pressurizing chamber 91 communicates with the first passage 73 via the liquid chamber 67. The first three-way valve 92 has a pressurizing chamber 91 communicating with the circulation recovery flow passage 76, and a fourth opening 78 communicating with the pressurizing chamber 91 communicates with the second flow passage 74 via the liquid chamber 68. An external opening 65 that opens to the outside is provided in a pressurizing chamber 91 that straddles the first on-off valve mechanism 25 and the fourth on-off valve mechanism 26. A flexible film 116 extending over the whole pressurizing chamber 91 is provided, and a pressing part 115 is attached to the flexible film 116. The pressing portion 115 faces the external opening 65. The circulation supply flow passage 75, the circulation recovery flow passage 76, the first flow passage 73, the second flow passage 74, and the external opening 65 are opened to the outside of the first three-way valve 92.

A first sealing part 89 is located in the pressurizing chamber 91 and held by a flexible film 113. The first sealing portion 89 faces the first opening 87, and is urged in a direction away from the first opening 87 by a spring 111 serving as an urging member. Similarly, a fourth sealing portion 80 is located in the pressure chamber 91 and is held by the flexible film 114. The fourth sealing portion 80 faces the fourth opening 78, and is urged in a direction away from the fourth opening 78 by a spring 112 serving as an urging member. The first sealing part 89 and the fourth sealing part 80 abut on the pressing part 115 in the pressurizing chamber 91. Therefore, in the initial state, the first sealing portion 89, the fourth sealing portion 80, and the pressing portion 115 are integrally separated from the first opening 87 and the fourth opening 78 by the urging force of the spring 111 and 112. As a result, the first opening 87 and the fourth opening 78 are opened without being closed by the first sealing part 89 and the fourth sealing part 80, the circulation supply flow passage 75 communicates with the first flow passage 73, and the circulation recovery flow passage 76 communicates with the second flow passage 74. That is, in the initial state shown in FIG. 8A, the first on-off valve mechanism 25 and the fourth on-off valve mechanism 26 are opened.

As shown in FIG. 8A, when fluid flows in from the external opening 65 while the first on-off valve mechanism 25 and the fourth on-off valve mechanism 26 are open, the flexible film 116 approaches the first opening 87 and the fourth opening 78 together with the pressing portion 115 while being deformed. Thereby, the first sealing portion 89 and the fourth sealing portion 80 close the first opening 87 and the fourth opening 78, respectively, and the communication between the circulation supply flow passage 75 and the first flow passage 73 and the communication between the circulation recovery flow passage 76 and the second flow passage 74 are respectively released and shut off. That is, the initial state shown in FIG. 8A is shifted to a state in which the first on-off valve mechanism 25 and the fourth on-off valve mechanism 26 are shifted to the closed state.

The second three-way valve 93 shown in FIG. 8B has a structure similar to the first three-way valve 92, has a pressurizing chamber 91 communicating with the circulation supply flow passage 75, and a second opening 88 communicating with the pressurizing chamber 91 communicates with the second flow passage 74 via the valve chamber 69. The pressurizing chamber 91 also communicates with the circulation recovery passage 76. A third opening 77 communicating with the pressurizing chamber 91 communicates with the first flow passage 73 via the valve chamber 70. The pressurizing chamber 91 is provided with an external opening 66 opened to the outside.

A flexible film 110 is provided in the pressurizing chamber 91, and a pressing part 109 is attached to the flexible film 110. The pressing portion 109 faces the external opening 66. The circulation supply flow passage 75, the circulation recovery flow passage 76, the first flow passage 73, the second flow passage 74 and the external opening 66 are opened to the outside of the second three-way valve 93.

A moving member 108 is located in the pressurizing chamber 91 and held by a flexible film 110. A second sealing part 90 is located in the valve chamber 69 and held by a flexible film 106. The moving member 108 and the second sealing part 90 are connected by a connection part 118 penetrating the second opening 88. The second sealing portion 90 faces the second opening 88, and is urged in a direction approaching the second opening 88 by a spring 104 serving as an urging member. Similarly, a moving member 107 is located within the pressure chamber 91 and is held by a flexible film 123. A third sealing part 79 is located in the valve chamber 70 and held by a flexible film 105. The moving member 107 and the third sealing part 79 are connected by a connection part 119 penetrating the third opening 77. The third sealing portion 79 faces the third opening 77, and is urged in a direction approaching the third opening 77 by a spring 103 serving as an urging member.

A moving member 108 and a moving member 107 abut on a pressing part 109 in a pressurizing chamber 91. The flexible film 106 and 105 is deformed by the urging force of the spring 104 and 103, and the second sealing part 90 and the third sealing part 79 abut on the second opening 88 and the third opening 77. As a result, the second sealing portion 90 and the third sealing portion 79 close the second opening 88 and the third opening 77, respectively, and the communication between the circulation supply flow passage 75 and the second flow passage 74 and the communication between the circulation recovery flow passage 76 and the first flow passage 73 are released and shut off. That is, in the initial state shown in FIG. 8B, the second on-off valve mechanism 71 and the third on-off valve mechanism 72 are closed.

As shown in FIG. 8B, when fluid flows in from the external opening 66 while the second on-off valve mechanism 71 and the third on-off valve mechanism 72 are closed, the flexible film 110 approaches the second opening 88 and the third opening 77 together with the pressing portion 109 while being deformed. As a result, the second sealing part 90 and the third sealing part 79 respectively connected to the moving member 108 and the moving member 107 are separated from the second opening 88 and the third opening 77 respectively against the urging force of the spring 104 and 103. As a result, the second opening 88 and the third opening 77 are opened without being closed by the second sealing part 90 and the third sealing part 79, the circulation supply flow passage 75 communicates with the second flow passage 74, and the circulation recovery flow passage 76 communicates with the first flow passage 73. That is, the initial state shown in FIG. 8B is shifted to a state in which the second on-off valve mechanism 71 and the third on-off valve mechanism 72 are opened.

Since the three-way valves 92 and 93 of the present embodiment can simultaneously open and close two on-off valve mechanisms by one pressing portion 115 and 109, downsizing and high efficiency can be achieved. In addition, since the pressing portion 115 and 109 can be moved by the inflow of fluid from the external openings 65 and 66, the on-off valve mechanism can be easily opened/closed. For example, when a fluid is made to flow simultaneously from a pneumatic drive passage 30 connected to one air pump 22 into the respective external openings 65 and 66 of the two three-way valves 92 and 93, work efficiency is further improved. In the configuration shown in FIG. 8A, the two on-off valve mechanisms 25 and 26 are opened in the initial state, and they can be simultaneously closed by the movement of the pressing portion 115. On the other hand, in the configuration shown in FIG. 8B, the two on-off valve mechanisms 71 and 72 are closed in the initial state, and they can be simultaneously opened by the movement of the pressing portion 109. Accordingly, in the liquid circulation unit 54 shown in FIGS. 4A and 4B, the three-way valve 92 including the first on-off valve mechanism 25 and the fourth on-off valve mechanism 26 is configured as shown in FIG. 8A, and the three-way valve 93 including the second on-off valve mechanism 71 and the third on-off valve mechanism 72 is configured as shown in FIG. 813. Thereby, the liquid circulation in the forward direction and the liquid circulation in the reverse direction in the liquid circulation unit 54 can be easily switched.

The so-called choke cleaning can be easily performed by closing all the on-off valve mechanisms 25, 71, 72 and 26 of the first and second three-way valves 92 and 93. In the choke cleaning, the negative pressure in the liquid flow passage is increased by closing all four on-off valve mechanisms 25, 71, 72 and 26, and capping and sucking the ejection port forming surface of the liquid ejection head 1. Thereafter, by opening all of the four on-off valve mechanisms 25, 71, 72 and 26, the liquid is made to flow in and the air is discharged from the ejection port 200*d*. As a result, the residual bubbles in the initial filling of the liquid can be reduced, and the recovery operation for discharging the bubbles in the liquid passage can be performed. As described above, in the three-way valves 92 and 93 of the present embodiment, all the on-off valve mechanisms 25, 71, 72 and 26 can be simultaneously closed and opened. The liquid circulation unit 54 can be downsized.

Fourth Embodiment

A fourth embodiment of the present disclosure will be described below. Since configuration of the liquid circulation unit 54 in this embodiment is different from that in the first embodiment, the difference will be mainly described.

Figure 9:
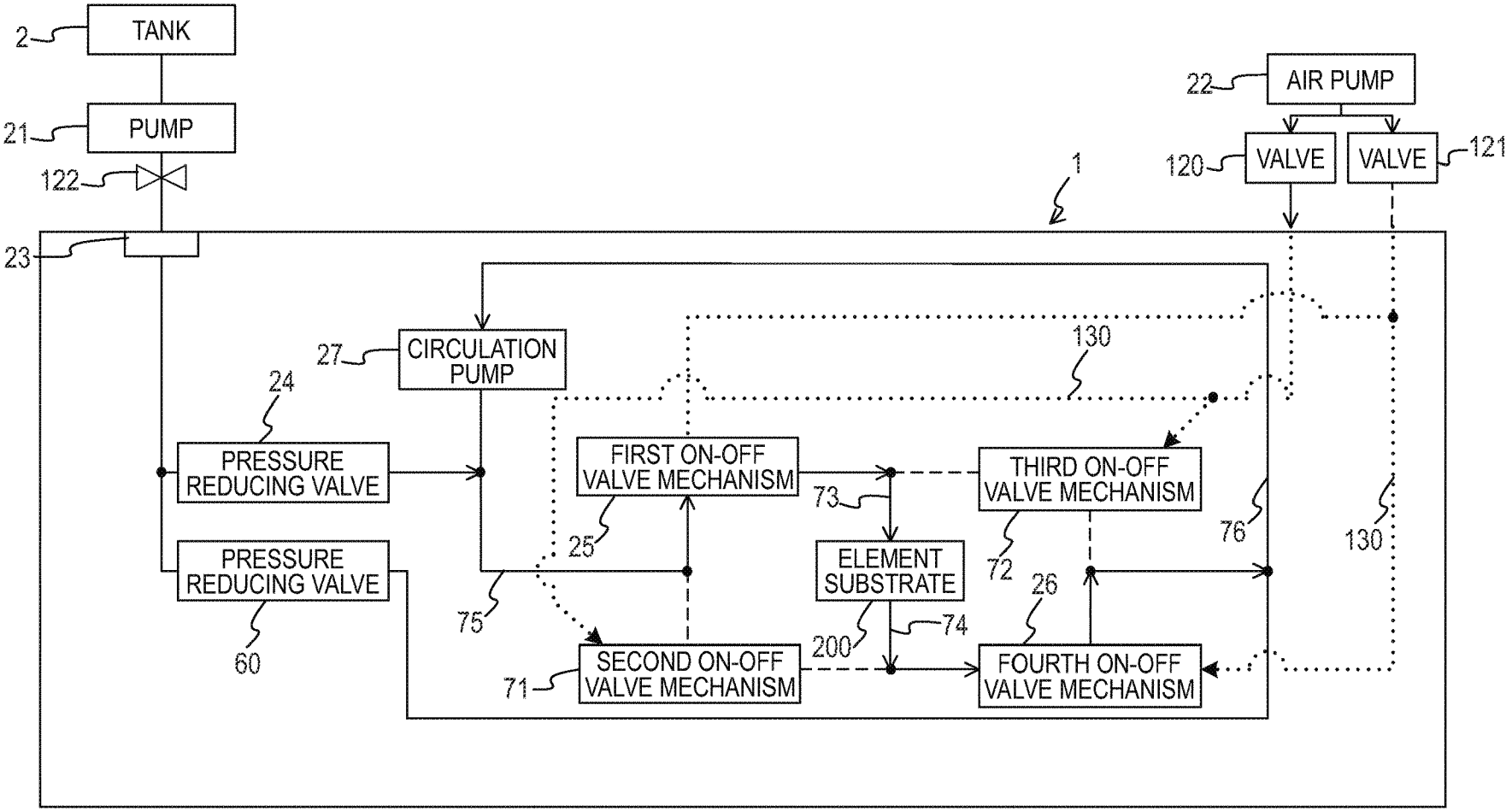
FIG. 9 is a block diagram showing a flow passage of a liquid ejection apparatus according to a fourth embodiment of the present disclosure.

Since the other points are the same as those of the first to third embodiment, the description thereof is omitted. FIG. 9 shows a circulation configuration of the liquid ejection apparatus of this embodiment.

The liquid ejection apparatus 50 has a line type liquid ejection head 1. In the line type liquid ejection head 1, for example, fifteen energy generating elements 200*e* are arranged side by side, and recording can be performed by one scan for the entire recording width of A3 size paper, and high-speed printing can be performed. In the line type liquid ejection head 1, the amount of the liquid circulating in proportion to the number of the energy generating elements 200*e* is large, and the amount of liquid ejected amount from all the ejection ports 200*d* is large. Therefore, in order to cope with the pressure drop when the liquid is ejected from all the ejection ports 200*d*, a differential pressure valve is not disposed between the pressure reducing valve 24 and the recovery flow passage of the element substrate 200, but a pressure reducing valve 60 is provided on the recovery side to control the pressure of the circulation recovery flow passage 76. A liquid supplied from a tank 2 to a liquid ejection head 1 via a valve 122 by the action of a pump 21 is circulated through an element substrate 200. The opening and closing of the opening and closing valve mechanisms 25, 26, 71 and 72 are controlled by pressurized air supplied from the air pump 22 to the liquid ejection head 1 via the valve 120 and 121, thereby determining the circulation direction of the liquid.

In addition, since the liquid is supplied to and recovered from the fifteen energy generating elements 200*d*, the liquid flow passage of the liquid is long and has a large volume, and since the pressure reducing valves 24 and 60 are provided, it takes a long time to recover suction or the like. Therefore, in order to reliably perform the recovery process in the vicinity of the energy generating element 200*d* which directly greatly affects the liquid ejection, it is preferable to perform the choke cleaning by opening all the on-off valve mechanisms 25, 71, 72 and 26 after closing them. For this purpose, it is particularly preferable to employ the three-way valves 92 and 93 of the third embodiment described above.

As described above, in the line-type liquid ejection head 1, the circulation flow passage is switched by using the on-off valve mechanisms 25, 71, 72 and 26 driven by the pressure of fluid such as air pressure, so that the liquid circulation unit 54 mounted on the liquid ejection head 1 can be downsized. A circulation direction switching mechanism in which the liquid supply configuration of the liquid ejection apparatus body is simplified can be realized.

As in the foregoing embodiments, the liquid ejection apparatus of the present disclosure comprises a first flow passage 73 and a second flow passage 74, and a plurality (e.g., four) of on-off valve mechanisms 25, 71, 72 and 26 for controlling communication and shut-off between the respective flow passages of the circulation supply flow passage 75 and the circulation recover flow passage 76. Each of the on-off valve mechanisms 25, 71, 72 and 26 has openings 87, 88, 77 and 78 located between flow passages, and scaling parts 89, 90, 79 and 80 capable of opening and closing the openings 87, 88, 77 and 78. Further, an urging member (for example, springs 103, 104, 111 and 112) for urging the sealing parts 89, 90, 79 and 80 in a direction to approach or away from the openings 87, 88, 77 and 78 is provided. Further, a movement mechanism for moving the sealing parts 89, 90, 79 and 80 against the urging force of the urging members 103, 104, 111 and 112 is provided. The sealing part of the at least two on-off valve mechanism are moved together by the movement mechanism to control opening and closing of the at least two on-off valve mechanisms. Specifically, the movement mechanism includes a pressurizing chamber 91, a flexible member (e.g., a flexible film 82, 110 and 116) located in the pressurizing chamber 91, and pressing portions 43 and 85 attached to the flexible members 82, 110 and 116. The pressing parts 43 and 85 press the sealing parts 89, 90, 79 and 80 while the flexible member 82, 110 and 116 pressurized in the pressurizing chamber 91 are bent and deformed.

However, as in the second embodiment shown in FIGS. 7A and 7B, the movement mechanism may include the pressurizing chamber 91 and the flexible members 101 and 96 located in the pressurizing chamber 91, and the sealing portions 89 and 80 may be attached to the flexible members 101 and 96, and the pressing portion may not be provided. In this configuration, the sealing portions 89 and 80 move while the flexible members 101 and 96 pressurized in the pressurizing chamber 91 are bent and deformed.

As described above, in the liquid ejection apparatus of the present disclosure, since the opening and closing of at least two on-off valve mechanisms are controlled by one movement mechanism, it is not necessary to provide an individual movement mechanism for each opening and closing valve mechanism. Therefore, the configuration of the liquid circulation unit 54 can be simplified, and the whole liquid ejection head 1 can be downsized. In particular, when the circulation supply passage 75 and the circulation recovery passage 76 of the liquid circulation unit 54 are connected via the circulation pump 27, the liquid can be easily circulated in the carriage 53 on which the element substrate 200 and the plurality of on-off valve mechanisms 25, 71, 72 and 26 are mounted.

Further, when the flexible members 82, 110, 116, 101 and 96 in the pressurizing chamber 91 are pressurized by introducing a fluid (preferably pressurized air) into the pressurizing chamber 91, the sealing portions 89, 90, 79 and 80 can be moved easily. When the flexible members 82, 110, 116, 101 and 96 form a part of the wall defining the pressurizing chamber 91, a configuration for pressurizing the flexible members 82, 110, 116, 101 and 96 by introducing a fluid into the pressurizing chamber 91 can be easily realized. Further, opening and closing control can be easily performed by forming a part of the wall partitioning the liquid flow passage between the flow passages connected via the on-off valve mechanisms 25, 71, 72 and 26 with the flexible members 81, 86, 96, 97, 101, 102, 104, 105, 113 and 114.

In each of the embodiments described above, the liquid in the vicinity of the ejection port 200*d* is allowed to flow, but only the liquid in the common passage may be allowed to flow. Further, the pump, the pressure adjusting mechanism, and the like are not limited thereto as long as they have functions equivalent to those of the above-described conformation. For example, circulation or pressure adjustment may be performed by the liquid head difference or the pressure control of the liquid tank. In the above-described embodiments, the air pump 22 for pressurizing air for driving the on-off valve mechanisms 25, 71, 72 and 26 is mounted on the apparatus side, but a compact air pump may be mounted on the carriage 53, in the above-described embodiments, the on-off valve mechanisms 25, 71, 72 and 26 are driven by pressurization using air, but the present disclosure is not limited thereto. The on-off valve mechanisms 25, 71, 72 and 26 may be driven by pressurization or depressurization using a fluid other than air. The urging member for controlling the opening and closing operation of the on-off valve mechanisms 25, 71, 72 and 26 is not limited to a coil spring, but may be a plate spring or other urging member.

According to the present disclosure, it is possible to provide a liquid ejection apparatus equipped with a small liquid ejection head capable of switching a liquid circulation flow passage.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-211644, filed Dec. 21, 2020, which is hereby incorporated by reference herein in its entirety.

What is claimed is:

1. A liquid ejection apparatus comprising:

a first flow passage and a second flow passage for supplying or recovering a liquid to an element substrate for ejecting the liquid;

a circulation supply flow passage for supplying liquid to the first flow passage or the second flow passage;

a circulation recovery flow passage for recovering liquid from the first flow passage or the second flow passage; and a plurality of on-off valve mechanisms for controlling communication and shutoff between the respective flow passages;

the on-off valve mechanism comprises an opening located between flow passages, a sealing portion capable of on-off the opening, an urging member for urging the sealing portion toward or away from the opening, and a movement mechanism for moving the sealing portion against the urging force of the urging member, wherein the movement mechanism moves the sealing portions of the at least two on-off valve mechanisms together to control opening and closing of the at least two on-off valve mechanisms.

2. The liquid ejection apparatus according to claim 1, wherein the movement mechanism includes a pressurizing chamber, a flexible member located in the pressurizing chamber, and a pressing portion attached to the flexible member, and the pressing portion presses the sealing portion while the flexible member pressurized in the pressurizing chamber is bent and deformed.

3. The liquid ejection apparatus according to claim 1, wherein the movement mechanism includes a pressurizing chamber and a flexible member located in the pressurizing chamber, the sealing portion is attached to the flexible member, and the sealing portion moves while the flexible member pressurized in the pressurizing chamber is bent and deformed.

4. The liquid ejection apparatus according to claim 2, wherein the flexible member in the pressurizing chamber is pressurized by introducing a fluid into the pressurizing chamber.

5. The liquid ejection apparatus according to claim 1, wherein the fluid introduced into the pressurizing chamber is pressurized air.

6. The liquid ejection apparatus according to claim 2, wherein the flexible member forms a part of a wall defining the pressurizing chamber.

7. The liquid ejection apparatus according to claim 1, wherein a part of a wall defining a liquid flow passage between the flow passages connected via the on-off valve mechanism is formed of a flexible member.

8. The liquid ejection apparatus according to claim 1, wherein the movement mechanism of the at least two on-off valve mechanisms is integrated to form a valve including the at least two on-off valve mechanisms.

9. The liquid ejection apparatus according to claim 1, further comprising a first on-off valve mechanism located between the circulation supply flow passage and the first flow passage, a second on-off valve mechanism located between the circulation supply flow passage and the second flow passage, a third on-off valve mechanism located between the circulation recovery flow passage and the first flow passage, and a fourth on-off valve mechanism located between the circulation recovery flow passage and the second flow passage.

10. The liquid ejection apparatus according to claim 9, wherein two three-way valves including the two on-off valve mechanisms are provided.

11. The liquid ejection apparatus according to claim 10, wherein the openings and the sealing portions of each of the two on-off valve mechanisms face each other across a liquid flow passage connected to the openings.

12. The liquid ejection apparatus according to claim 10, wherein: a first three-way valve includes the first on-off valve mechanism and the second on-off valve mechanism; one of the first on-off valve mechanism and the second on-off valve mechanism is opened and the other is simultaneously closed; and a second three-way valve includes the third on-off valve mechanism and the fourth on-off valve mechanism; and one of the third on-off valve mechanism and the fourth on-off valve mechanism is opened and the other is simultaneously closed.

13. The liquid ejection apparatus according to claim 12, wherein the first three-way valve opens the first on-off valve mechanism to close the second on-off valve mechanism, and at the same time, the second three-way valve opens the fourth on-off valve mechanism to close the third on-off valve mechanism, the first three-way valve opens the second on-off valve mechanism to close the first on-off valve mechanism, and at the same time, the second three-way valve opens the third on-off valve mechanism to close the fourth on-off valve mechanism.

14. The liquid ejection apparatus of claim 12, wherein the sealing portion is part of a rocker mechanism rotatable about a shaft.

15. The liquid ejection apparatus according to claim 14, a regulating portion for regulating a range of rotational motion of the rocker mechanism is provided.

16. The liquid ejection apparatus according to claim 10, wherein: a first three-way valve includes the first on-off valve mechanism and the fourth on-off valve mechanism; the first on-off valve mechanism and the fourth on-off valve mechanism are simultaneously opened and closed; and a second three-way valve includes the second on-off valve mechanism and the third on-off valve mechanism; and the second on-off valve mechanism and the third on-off valve mechanism are simultaneously opened and closed.

17. The liquid ejection apparatus according to claim 16, wherein the first three-way valve opens the first on-off valve mechanism and the fourth on-off valve mechanism, and the same time, the second three-way valve closes the second on-off valve mechanism and the third on-off valve mechanism, the first three-way valve closes the first on-off valve mechanism and the fourth on-off valve mechanism, and the same time, the second three-way valve opens the second on-off valve mechanism and the third on-off valve mechanism.

18. The liquid ejection apparatus according to claim 16, wherein the urging member of the first on-off valve mechanism and the urging member of the fourth on-off valve mechanism both urge the sealing portion toward the opening, and the urging member of the second on-off valve mechanism and the urging member of the third on-off valve mechanism both urge the sealing portion away from the opening.

19. The liquid ejection apparatus according to claim 1, wherein the circulation supply flow passage and the circulation recovery flow passage are connected via a circulation pump, and the liquid is circulated in the carriage on which the element substrate and the plurality of on-off valve mechanisms are mounted.

* * * * *